US008851204B2

(12) United States Patent
Knull et al.

(10) Patent No.: US 8,851,204 B2
(45) Date of Patent: Oct. 7, 2014

(54) MUD MOTOR WITH INTEGRATED PERCUSSION TOOL AND DRILL BIT

(75) Inventors: Craig Knull, Edmonton (CA); Justin Forbes, Minot (CA)

(73) Assignee: Ulterra Drilling Technologies, L.P., Fort Worth, TX (US)

( * ) Notice: Subject to any disclaimer, the term of this patent is extended or adjusted under 35 U.S.C. 154(b) by 358 days.

(21) Appl. No.: 13/450,084

(22) Filed: Apr. 18, 2012

(65) Prior Publication Data

US 2013/0277116 A1 Oct. 24, 2013

(51) Int. Cl.
*E21B 10/38* (2006.01)
*E21B 7/00* (2006.01)

(52) U.S. Cl.
USPC ..... 175/296; 175/107

(58) Field of Classification Search
USPC ..... 175/107, 296, 293, 320; 173/104
See application file for complete search history.

(56) References Cited

U.S. PATENT DOCUMENTS 3,840,080 A 10/1974 Berryman
4,098,561 A 7/1978 Tschirky et al.
4,144,941 A * 3/1979 Ritter ..... 175/19
4,220,380 A 9/1980 Crase et al.
4,246,976 A 1/1981 McDonald, Jr.
4,295,535 A 10/1981 Crase et al.
4,492,276 A 1/1985 Kamp
4,546,836 A 10/1985 Dennis et al.
4,577,704 A 3/1986 Aumann
4,683,964 A 8/1987 Wenzel
4,772,246 A 9/1988 Wenzel
5,048,981 A 9/1991 Ide
5,090,497 A 2/1992 Beimgraben et al.
5,096,004 A 3/1992 Ide
5,156,223 A * 10/1992 Hipp ..... 175/296
5,195,754 A 3/1993 Dietle
5,217,080 A 6/1993 Wenzel et al.
5,248,204 A 9/1993 Livingston et al.
5,267,905 A 12/1993 Wenzel et al.
5,377,771 A 1/1995 Wenzel
5,385,407 A 1/1995 De Lucia
5,396,965 A * 3/1995 Hall et al. ..... 173/73
5,449,046 A * 9/1995 Kinnan ..... 175/24
5,495,900 A 3/1996 Falgout, Sr.
5,588,818 A 12/1996 Houmand et al.
5,704,838 A 1/1998 Teale
6,073,708 A 6/2000 Brown et al.
6,183,226 B1 2/2001 Wood et al.
6,202,762 B1 3/2001 Fehr et al.
6,253,864 B1 * 7/2001 Hall ..... 175/415
6,328,119 B1 12/2001 Gillis et al.
6,416,225 B1 7/2002 Cioceanu et al.
6,527,513 B1 * 3/2003 Van Drentham-Susman et al. ..... 415/202
6,533,052 B2 * 3/2003 Wentworth et al. ..... 175/398
6,609,577 B2 * 8/2003 Beccu ..... 173/93.6
6,659,202 B2 * 12/2003 Runquist et al. ..... 175/61

(Continued)

*Primary Examiner* — Daniel P Stephenson

(57) ABSTRACT

A downhole tool having a progressive cavity mud motor with an impact generator disposed within the mud motor rotor or bearing assembly. In one embodiment, the impact generator includes a mud turbine connected to a eccentric ring that encircles and periodically strikes an anvil surface of a percussion shaft. The eccentric ring is pivotable between an engaged striking position and a disengaged non-striking position. The percussion shaft is coupled to a drill bit though a splined connector that provides limited slip for transmitting rotation of the mud motor rotor to the drill bit and for transmitting percussion strikes against the anvil to the drill bit without the need to accelerate the entire drill string.

12 Claims, 9 Drawing Sheets

(56) References Cited

U.S. PATENT DOCUMENTS

| | | | | |
|---|---|---|---|---|
| 6,742,605 | B2 * | 6/2004 | Martini | 175/57 |
| 6,742,609 | B2 | 6/2004 | Gillis et al. | |
| 6,827,160 | B2 | 12/2004 | Blair et al. | |
| 6,905,319 | B2 | 6/2005 | Guo | |
| 6,949,025 | B1 | 9/2005 | Kraus et al. | |
| 6,986,394 | B2 * | 1/2006 | Marsh | 173/13 |
| 7,004,843 | B1 | 2/2006 | Kerstetter | |
| 7,073,610 | B2 * | 7/2006 | Susman | 175/51 |
| 7,186,182 | B2 | 3/2007 | Wenzel et al. | |
| 7,240,744 | B1 * | 7/2007 | Kemick | 175/106 |
| 7,303,007 | B2 * | 12/2007 | Konschuh et al. | 166/250.01 |
| 7,416,034 | B2 * | 8/2008 | Downie et al. | 175/107 |
| 7,424,922 | B2 * | 9/2008 | Hall et al. | 175/317 |
| 7,500,787 | B2 | 3/2009 | Cioceanu | |
| 2002/0084109 | A1 * | 7/2002 | Runquist et al. | 175/61 |
| 2002/0088648 | A1 * | 7/2002 | Krueger et al. | 175/99 |
| 2002/0166700 | A1 * | 11/2002 | Gillis et al. | 175/57 |
| 2002/0185312 | A1 * | 12/2002 | Armell et al. | 175/19 |
| 2003/0024739 | A1 * | 2/2003 | Runquist et al. | 175/61 |
| 2007/0137897 | A1 * | 6/2007 | Sanders et al. | 175/61 |
| 2010/0032209 | A1 * | 2/2010 | Rainey et al. | 175/40 |
| 2011/0232970 | A1 * | 9/2011 | Miller et al. | 175/57 |
| 2013/0277116 | A1 * | 10/2013 | Knull et al. | 175/57 |

* cited by examiner

MUD MOTOR WITH INTEGRATED PERCUSSION TOOL AND DRILL BIT

BACKGROUND OF THE INVENTION

1. Field of the Invention

This invention relates generally to downhole tools used for boring petrolitic wells and specifically to a downhole drilling-fluid-powered motor with integrated rotary torque-intensifying percussion tool useful for driving diamond drag-type drill bits.

2. Background Art

In normal drilling conditions polycrystalline diamond compact (PDC) drill bits can bore through certain earthen formations with amazing speed and efficiency. However, when drilling with aggressive PDC bits, an undesirable effect known as "stick-slip" can occur when the drill bit encounters a particularly hard formation, such as an inter-bedded stringer. In stick-slip, the drill bit catches or seizes in the subsurface formation when there is insufficient torque at the bit to shear the rock. Despite the momentarily slowing or stopping of the drill bit, the drill string continues to rotate and torsional potential energy accumulates in the length of the upper end of the drill string. Once sufficient torque is generated at the bit to shear the rock, or to disengage the bit from the formation due to shortening of the drill string as it winds up, the bit violently breaks free at higher speeds than normal. The release of wound-up torsional energy as the bit spins may cause bit chatter or repeated impacting of the diamond cutters against the rock face. PDC cutters perform well under constant loading but are subject to failure under impact loading. Because of this characteristic, the stick-slip phenomenon tends to compromise the integrity of the diamond inserts and may cause cutter damage, bit failure and concomitant loss of drilling time.

One methodology in dealing with stick-slip is centered on preserving the bit. To achieve this objective, the bit is made more passive and heavy-set, and/or weight-on-bit is reduced. However, these changes make drilling less efficient and result in lower rates of penetration. Alternatively, roller cone bits are employed. But, roller cone bits are less efficient, and they also increase the risk of lost components in the well bore.

A more effective solution is to employ a relatively high-frequency rotational impact to the drill bit in conjunction with steady drill string torque. The repeated percussive impacts applied to the drill bit result in periodic torque impulses to promote shearing of the rock formation. Percussive impacts are provided by a rotational impact tool disposed in the drill string above the drill bit. Such a tool has been shown to be effective in reducing bit lock-up and minimizing harmful drill string windup. One such device is disclosed in U.S. Pat. No. 6,742,609 entitled "Rotational Impact Drill Assembly" and issued on Jun. 1, 2004 to inventors Peter J Gillis, Ian G. Gillis, and Craig. J. Knull, which is incorporated herein by reference.

The impact-generating tool mentioned above may be included in a bottom hole assembly between a downhole mud motor and a diamond drill bit. The downhole motor converts hydraulic energy of the drilling fluid, or mud, into mechanical energy in the form of torque and rotational speed for rotating a drill bit via the impact generator.

It is also generally desirable to shorten the length of the bottom hole assembly (i.e., the "bit-to-bend" length) to reduce the radius in a transition from a vertical to a horizontal bore. Accordingly, it is desirable to gain the advantages of impact generation but without suffering the penalty of an increased bit-to-bend length due to the inclusion of an impact generating tool in the bottom hole assembly. Such would control torque and minimize erratic tool face, which has plagued fixed cutter bits in tight turns, thereby enhancing the ability to drill high-build-rate sections with a PDC bit.

3. Identification of Objects of the Invention

A primary object of the invention is to provide an apparatus characterized by a short bit-to-bend length that facilitates the ability to drill high-build-rate well section with a drag-type drill bit.

Another object of the invention is to provide an apparatus that improves the ability to drill build sections with a drag-type drill bit and continue to drill horizontal sections without the need to trip the drill string out of the hole.

Another object of the invention is to provide an "all-in-one" apparatus that minimizes torque build-up, improves the life of drag-type bits, and that is capable of drilling directional wells.

SUMMARY OF THE INVENTION

The objects described above and other advantages and features of the invention are incorporated in a downhole tool that includes a progressive cavity positive displacement mud motor, characterized by a multi-lobed rotor that rotates within an elastomeric stator, for providing rotational power to a drill bit. The tool further includes an impact generating assembly that drives a percussion assembly, which provides periodic impulses to the drill bit. The impact generating assembly is located within a bore formed through the rotor of the positive displacement mud motor or within the bearing assembly for the positive displacement mud motor.

In one embodiment, the impact generating assembly includes a mud turbine that drivens a percussion assembly. When located within the rotor of the positive displacement mud motor, the tool defines two drilling fluid flow paths: An annular stream of drilling fluid flows through the progressive cavity mud motor rotor/stator interface, and a central stream flows through the mud turbine within the progressive cavity motor rotor. The lower end of progressive cavity pump rotor is connected to the drill bit through a drive shaft and universal joints, which allow for orbital counter-nutation of the rotor during rotation.

The mud turbine shaft is connected to first and second yoke arms, which are likewise preferably located within the bore formed through the rotor. An eccentric ring, which includes a hammer surface, is disposed between the two yoke arms. A percussion shaft, which includes an anvil surface, is disposed within the eccentric ring. The eccentric ring is pivotable between an engaged position, in which the hammer and the anvil are located so that the hammer strikes the anvil, and a disengaged position, in which the hammer is located at a greater distance from the anvil so that they do not make contact. Each revolution of the eccentric ring about the percussion shaft brings hammer into contact with anvil for periodically applying a percussive impact to the drill bit. Each impact temporarily arrests the rotation of the hammer, but the hammer disengages from the anvil and accelerates to raise its rotational kinetic energy for the next impact.

The percussion shaft is partially decoupled rotationally from the housing by a splined coupling assembly for permitting substantially all of the impact energy to be transferred to the drill bit and not the drill string. The splined coupling assembly includes an enlarged boss with radially projecting ears. Within the bore of the rotor, an equal number of inwardly projecting teeth engage the ears with about five degrees of slop. During operation, the rotating rotor drives the drill bit thought the splined coupling assembly. The slop allows the ears to disengage from the driving teeth for each impact of the hammer against the anvil. In this manner, the drill bit is momentarily decoupled from the drill string so that substantially all of the impact energy is imparted it into the drill bit without the need to also accelerate the entire drill string.

BRIEF DESCRIPTION OF THE DRAWINGS

The invention is described in detail hereinafter on the basis of the embodiments represented in the accompanying figures, in which.

DESCRIPTION OF THE PREFERRED EMBODIMENT OF THE INVENTION

Figure 1:
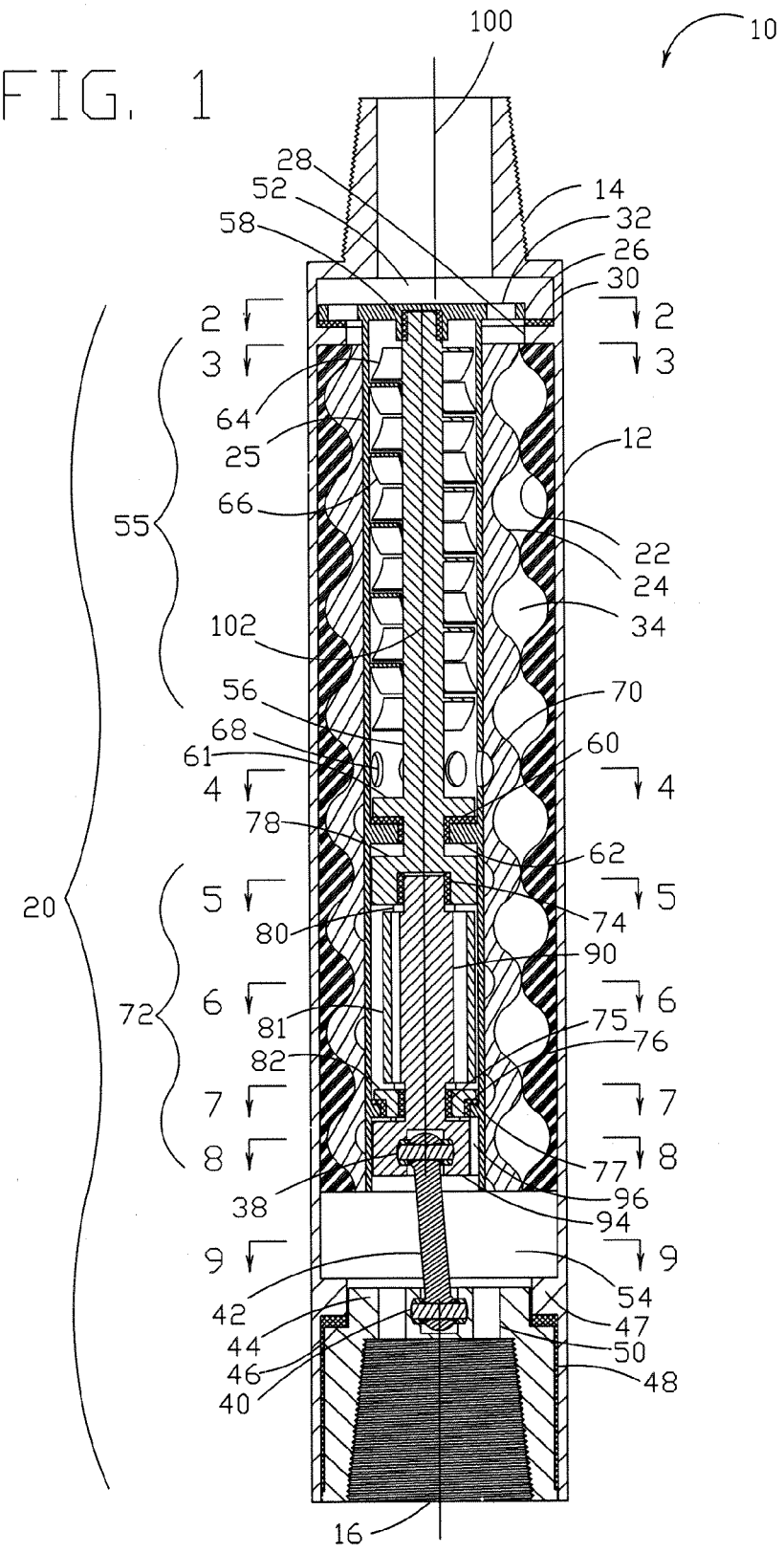
FIG. 1 is a side view in axial cross-section of a percussive impact tool integrated into the rotor of a positive displacement downhole mud motor according to a first embodiment of the invention.
Figure 2:
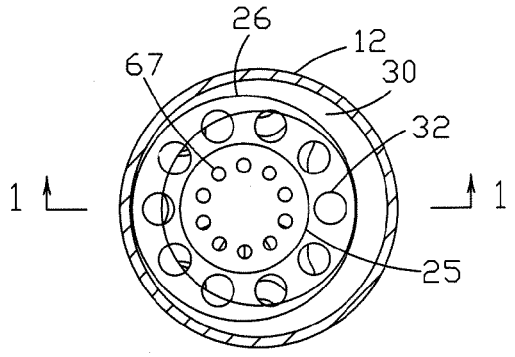
FIG. 2 is a transverse cross-section taken along lines 2-2 of FIG. 1, showing an outer row of fluid ports for directing mud flow to the positive displacement mud motor and an inner row of fluid ports for directing mud flow to a turbine of the impact tool.

Referring to FIG. 1, a downhole tool 10 according to a first embodiment of the invention is shown in axial cross-section. Tool 10 is packaged in a tubular housing 12 and includes an upper threaded pin connector 14 and a lower threaded box connector 16 as is customary in the art. Pin connector 14 is fixed to housing 12. Pin connector 14 is ordinarily connected to a drill string (not illustrated), thereby rigidly connecting housing 12 to the drill string. A drill bit fitted with PDC cutters (not illustrated) is ordinarily threaded to box connector 16. Rotation combined with percussive impacting is applied to the attached drill bit by operation of tool 10 using pressurized drilling fluid as a power source.

Figure 3:
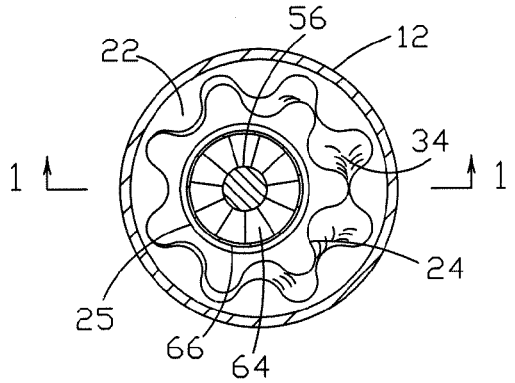
FIG. 3 is a transverse cross-section taken along lines 3-3 of FIG. 1, showing a positive displacement mud motor with an eight-lobed stator and a seven-lobed rotor, with a mud turbine disposed within the lobed mud motor rotor.

Tool 10 includes a progressive cavity positive displacement mud motor 20 for providing rotational power to a drill bit (not illustrated) attached to box connector 16. A positive displacement motor (PDM), often called a progressing cavity motor or Moineau motor, has a power section defined by a longitudinal steel rotor 24 having a number n of helical lobes that is received into a longitudinal elastomeric stator 22 having a number n+1 helical lobes of the same pitch. (See also, e.g., FIG. 3.) Tool 10 also includes an impact generating assembly, including a turbine mud motor 55 that drives a percussive assembly 72, which is located within a bore formed through rotor 24 of PDM 20. The impact generating assembly provides periodic impulses to the attached drill bit for preventing "stick-slip."

Due to the particular geometry of progressive cavity mud motor 20, rotor 24 defines a number of sealed cavities 34 within stator 22. Rotation of rotor 24 in a first direction results in a hypocycloidal revolution, or nutation, of rotor 24 around the interior surface of stator 22 in the opposite direction. That is, the centerline 102 of rotor 24 orbits in a small circle centered about the tool axis 100 n times for every one complete rotation of the rotor 24. Rotation of rotor 24 also has the effect of moving the individual sealed cavities 34 in a corkscrew pattern axially along the power section. Accordingly, by forcing the individual sealed cavities 34 to travel longitudinally under the influence of a differential pressure across the power section, rotor 24 is caused to rotate.

In a first embodiment, the upper end of rotor 24 terminates in a flange 26. Flange 26 is axially supported by an interior circular ledge or shoulder 28 formed in housing 12. A thrust bearing 30 is disposed between ledge 28 and flange 26, which allows flange 26 to freely orbit while being axially supported by ledge 28. However, other suitable arrangements that axially support rotor 24 within stator 22 may be used as appropriate.

Drilling fluid enters tool 10 through pin fitting 14 and flows into an inlet plenum 52. From inlet plenum 52, drilling fluid is divided into two flow paths. A annular stream of drilling fluid flows through the progressive cavities 34 that are formed in the rotor/stator interface of PDM 20. This annular stream of drilling fluid powers PDM 20. The remainder of the drilling fluid flows through and rotates mud turbine 55, which is centered within the PDM rotor 24. Turbine 55 in turn rotates impact generating assembly 72.

A first set of apertures 32 formed in flange 26 allows the annular stream of drilling mud to flow past flange 26, ledge 28, and bearing 30 into the uppermost progressive cavity 34.

Motor 20 operates by this annular stream of pressurized drilling fluid being forced through the rotor-stator interface under a differential pressure. The differential fluid pressure across the power section forces the cavities 34 to progress in a corkscrew fashion axially down the pump, which forces rotor 24 to rotate and counter-nutate, as described above.

For a given mud motor configuration, the rotational speed is proportional to the mud flow rate through the power section. For a given mud flow rate, design torque and speed of the PDM may be varied by changing the number n of lobes, the stage length (the pitch), and/or the number of stages (i.e., the longitudinal length of the power section). Low speed PDMs typically are characterized by a rotor-to-stator lobe configuration of 5:6, 6:7, 7:8, 8:9, or 9:10, medium speed PDMs may have a rotor-to-stator lobe configuration of 3:4 or 4:5, and high speed PDMs usually employ a rotor-to-stator lobe configuration of 1:2 or 2:3. Because of the greater number of stages, longer power sections can generally withstand higher differential pressure with less fluid slippage or leakage past the rotor-stator interface, and thus are capable of producing higher output power, than shorter power sections.

Figure 13:
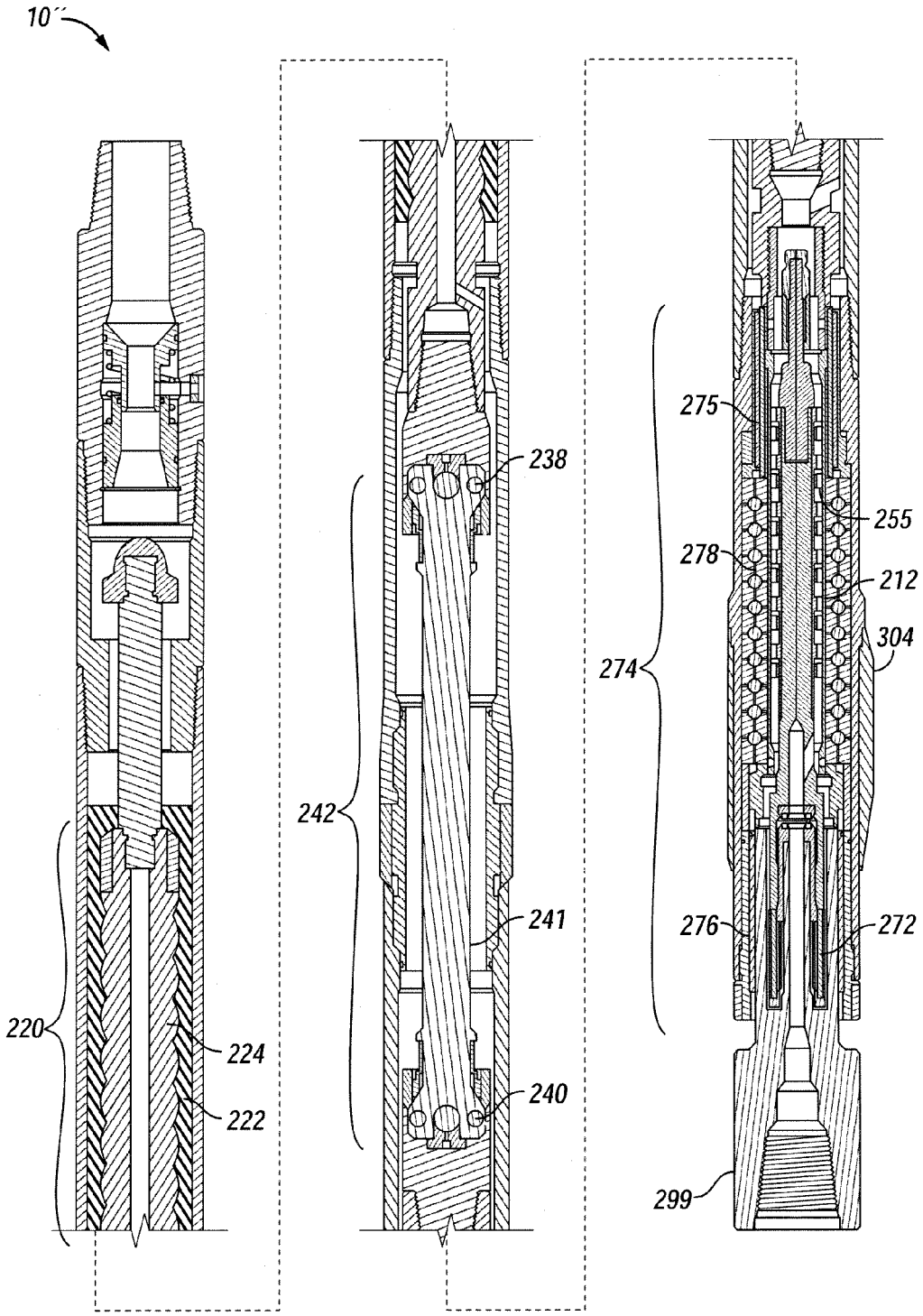
FIG. 13 is a side view in axial cross-section of a percussive impact tool integrated into the bearing assembly of a positive displacement downhole mud motor according to an alternate embodiment of the invention.

FIG. 1 shows a simplified transmission and bearing arrangement for the purpose of illustrating the basic operation of downhole tool 10, although in practice PDM transmission and bearing sections tend to be larger and more complicated, resembling more the embodiment illustrated in FIG. 13. The lower end of rotor 24 is connected to a box fitting 44 by an upper universal joint 38, a drive shaft 42, and a lower universal joint 40. The connection between rotor 24 and upper universal joint is effected by splined coupling assembly, which is described in detail with respect to FIGS. 1, 8, and 11 below. Box connector 16 is formed within the lower end of box fitting 44. Box fitting 44 is rotatively captured within the lower end of housing 12 and is radially supported by journal bearing 48. An interior shoulder or ledge 47 is formed in housing 12 for transmitting axial thrust forces between housing 12 and box fitting 44. A thrust bearing 46 is disposed between ledge 47 and box fitting 44.

As rotor 24 rotates due to mud flow through the progressive cavities 34 of the rotor/stator interface, drive shaft 42 rotates, thereby rotating box fitting 44 within housing 12. The upper and lower universal joints 38, 40 allow for the orbital counter-nutation of rotor 24 while allowing box fitting 44 to be confined to simple rotation about tool centerline 100. Constant velocity joints may be used in place of universal joints if desired.

Figure 9:
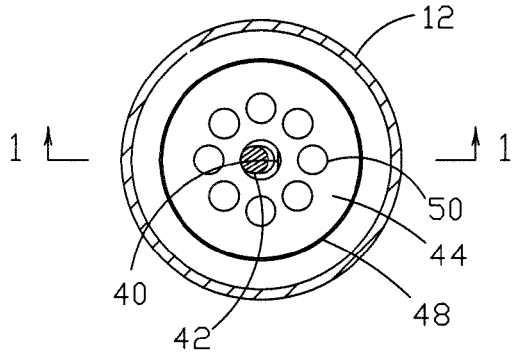
FIG. 9 is a transverse cross-section taken along lines 9-9 of FIG. 1 through the plenum that recombines mud flow from the positive displacement motor and mud flow from the mud turbine, showing fluid ports for discharging the drilling mud out of the tool.

The annular stream of drilling fluid exiting progressive cavities 34 enters an outlet plenum 52. In outlet plenum 52, the annular stream of drilling fluid that flows through the power section is rejoined with the central stream of drilling fluid that flows through turbine 55. (The flow path of the central stream of drilling fluid through the impact generating assembly is described below.) From outlet plenum 52, the combined drilling fluid flows into box connector 16 via a number of apertures 50 formed within box fitting 44 (see also, FIG. 9), thereby providing a supply of pressurized mud to be jetted through nozzles in an attached drill bit (not illustrated), as is conventional in the art.

Referring to FIGS. 1-4, the impact generating assembly includes a sleeve housing 25 that is pressed into a bore formed through rotor 24. The upper portion of the impact generating assembly includes a turbine mud motor 55. Turbine mud motor 55 includes a drive shaft 56 that includes a number of rows of angled turbine blades 64 fixed thereto. Redirecting blades 66 are disposed between the rows of turbine blades 64. Redirecting blades 66 are fixed to sleeve 25. Turbine shaft 56 includes an exterior shoulder 61 that is axially supported by an interior shoulder 62 formed in housing sleeve 25. Turbine drive shaft 56 is rotatively supported at its upper end by a journal bearing 58 and near its lower end by a combination thrust and journal bearing 60 that is disposed between exterior shoulder 61 and interior shoulder 62.

Figure 4:
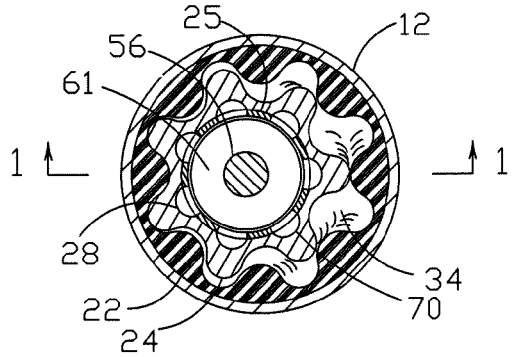
FIG. 4 is a transverse cross-section taken along lines 4-4 of FIG. 1, showing radial mud turbine outlet ports in communication with helical conduits formed within the lobed mud motor rotor.
Figure 5:
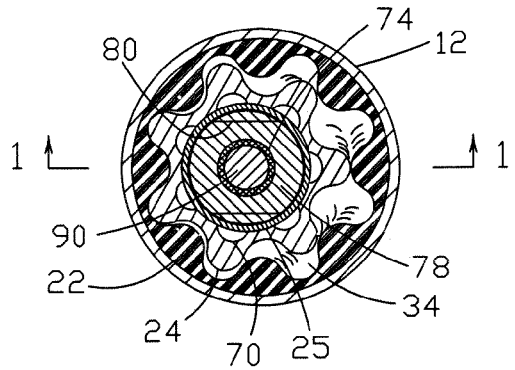
FIG. 5 is a transverse cross-section taken along lines 5-5 of FIG. 1, showing within the lobed rotor an outer inertial mass, which is connected to the mud turbine, and an inner percussion drive shaft that is radially supported within the inertial mass.
Figure 6:
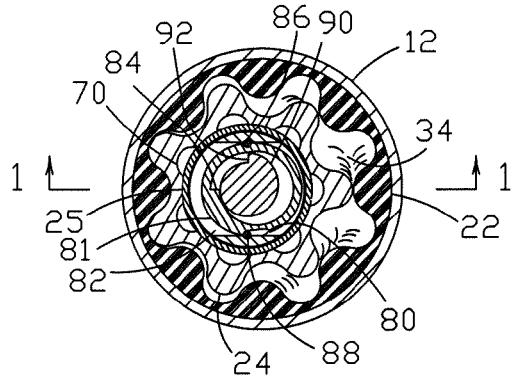
FIG. 6 is a transverse cross-section taken along lines 6-6 of FIG. 1, showing within the lobed rotor a percussion hammer assembly pivotally mounted between first and second yoke arms, which are connected to the inertial mass, and an anvil surface formed on the percussion drive shaft.
Figure 7:
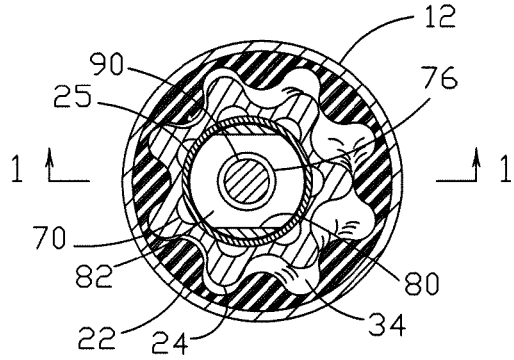
FIG. 7 is a transverse cross-section taken along lines 7-7 of FIG. 1, showing within the lobed rotor a collar that connects the lower ends of the yoke arms.

Rotor flange 26 is connected to housing sleeve 25. A second inner set of apertures 67 in flange 26 (visible only in FIG. 2) admits the center stream of drilling fluid from inlet plenum 52 into turbine 55. As fluid flows within the interior of sleeve 25, it impinges upon turbine blades 64, thereby imparting some of its kinetic flow energy into relatively high-speed rotation of turbine shaft 56. Below the last row of turbine blades 64, a series of radial drilling fluid outlet ports 68 is formed through housing sleeve 25. As illustrated in FIGS. 1 and 4, outlet ports 68 align with fluid conduits or channels 70 that are formed in the lower half of the interior wall surface of the borehole in rotor 24 into which housing sleeve 25 is pressed. Flow channels 70 radially correspond to the position of the lobes and helically wind down the interior of rotor 24. Flow channels 70 exit into outlet plenum 54, wherein drilling fluid exiting turbine 55 is recombined with drilling fluid exiting the progressive cavities 34 of the Moineau mud motor 20.

The structure of percussion assembly 72 is now described. Referring in particular to FIGS. 1 and 5-8, the lower end of turbine shaft 56 is connected to a mass 78 (which increases the moment of inertia, thereby providing for storage of additional rotational kinetic energy to be converted to percussive strikes) and to first and second yoke arms 80 that are disposed on opposite ends of a diameter centered on the drive shaft axis 102. The lower ends of yoke arms 80 are connected to a collar 82, which provides strength and rigidity to yoke arms 80 and which interfaces with a collar bearing 76 and an interior circular lip 77 formed in sleeve 25 to provide axial and radial support.

Inertial mass 78 and collar 82 include upper and lower percussion drive shaft journal bearings 74, 75, respectively, which together rotatively support a percussion drive shaft 90. Below lower percussion drive shaft bearing 75, percussion drive shaft 90 terminates in a splined coupling assembly, by which the rotation of the Moineau rotor 24 is transferred to upper universal joint 38 and by which percussive strikes to drive shaft 90 (as explained below) are isolated from all of the proceeding components. Details of splined coupling assembly are presented below with reference to FIGS. 1, 8, and 11.

Referring to FIGS. 1, 6, 10A, and 10G, an eccentric ring 81 encircles a length of percussion shaft 90 between upper and lower percussion shaft journal bearings 74, 75. The interior wall of eccentric ring 81 forms a radially inward projecting hammer surface 84. The length of percussion shaft 90 that is disposed within eccentric ring 81 is also eccentric and forms a radially outward projecting anvil 92. Eccentric rig is pivotable within yoke arms 80 between an engaged position (see, e.g., FIG. 10A), in which hammer 84 and anvil 92 are located at the same radius from rotor centerline 102 so that hammer 84 strikes anvil 92, and a disengaged position (see, e.g., FIG. 10G), in which hammer 84 is located at a greater distance than anvil 92 from rotor centerline 102 so that hammer 84 does not make contact with anvil 92.

In particular, eccentric ring 81 is pivotally connected to the interior side of a first yoke arm 80A so as to pivot about a point lying on the exterior circumference of eccentric ring 81 approximately ninety degrees from hammer 84. Eccentric ring 81 has a longitudinal semicircular notch centered as this pivot point. Likewise, the interior side of first yoke arm 80A has a longitudinal semicircular notch formed at its midpoint. These notches are dimensionally sized so as to receive a pivot pin 86, about which eccentric ring 81 pivots.

As with yoke arm 80A, the interior side of the second yoke arm 80B has a longitudinal semicircular notch formed at its midpoint. A yoke stopper pin 88 is seated within this notch. Stopper pin 88 may also be formed integrally with yoke arm, 80B, or similar arrangements may be used in the alternative. A longitudinal groove 83 is formed in the exterior surface of eccentric ring 81 diametrically opposite pivot pin 86. Unlike the notch that accommodates pivot pin 86, however, groove 83 is widened circumferentially a distance slightly greater than the radial dimension of hammer surface 84. Yoke stopper pin 88 is loosely captured within axial groove 83. Eccentric ring 81 freely pivots about yoke pivot pin 86, but its travel is limited by the relative travel of yoke stopper pin 88 within groove 83. The range of pivotal travel of eccentric ring 81, limited by the circumferential width of axial groove 83, is between that of the engaged and disengaged positions.

The operation of percussion assembly 72 is now described with reference to FIGS. 10A-10J, which illustrate one impact cycle. The rotating turbine shaft 56 rotates yoke arms 80A, 80B and eccentric ring 81. Each relative revolution of eccentric ring 81 about percussion shaft 90 brings hammer 84 into contact with anvil 92 for periodically applying a percussive impact to the drill bit. At each impact, the combined rotational momentum of eccentric ring 81, yoke arms 80A, 80B, inertial mass 78, and turbine shaft 56 is substantially transferred to percussion shaft 90, thereby creating an instantaneous torque impulse. Each impact temporarily arrests the rotation of hammer 84. However, hammer 84 disengages from the anvil 92 and accelerates through over 360 degrees of rotation to raise its kinetic energy for the next impact.

Figure 10A:
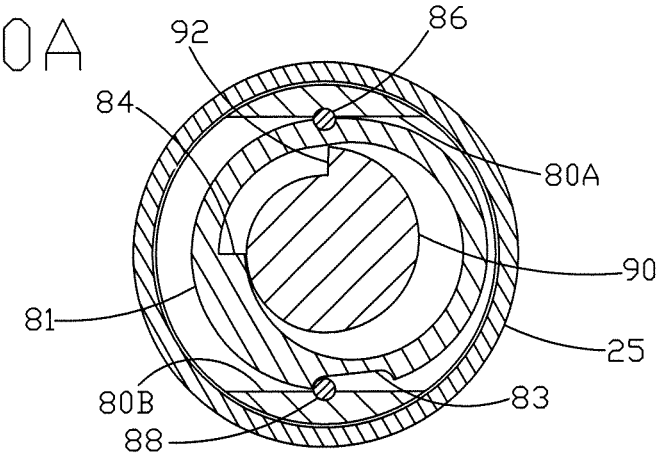
FIG. 10A is an enlarged partial view of FIG. 6, showing only the percussion generating assembly that is located with in the lobed rotor of the positive displacement mud motor.

FIG. 10A illustrates the arrangement where hammer 84 is positioned ninety degrees prior to impact with anvil 92. Percussion shaft 90 rotates clockwise as rotor 22 is driven clockwise by PDM 20, connected by the splined coupling arrangement as described below with respect to FIGS. 1, 8, and 11. Yoke arms 80A, 80B, driven by turbine 55, also rotate clockwise, but at a faster rate than percussion shaft 90. Yoke arms 80A, 80B drive eccentric ring 81. Inertial resistance of eccentric ring 81, manifested as a tendency of eccentric ring 81 to lag behind yoke arms 80A, 80B, causes stopper pin 88 to be seated at the leading edge of groove 83, as depicted in FIG. 10A. Such engaged position of eccentric ring 81 relative to stopper pin 88 places hammer 84 at approximately the same radius—the striking radius—as anvil 92.

Figure 10B:
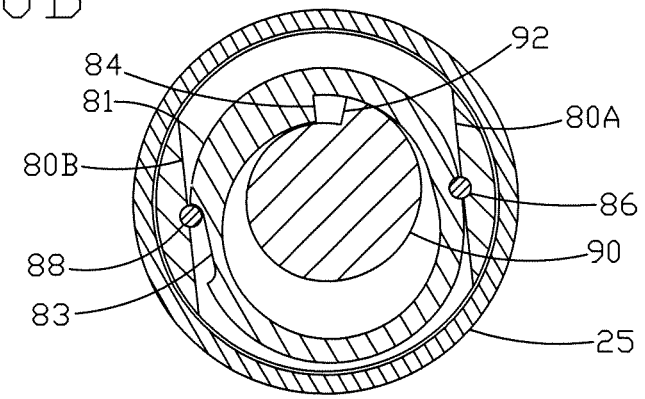
FIGS. 10B-10J are cross section views of the percussion generating assembly of FIG. 10A showing the percussion hammer assembly and the percussion drive shaft positioned in various states, which together with FIG. 10A sequentially shows a single percussion cycle in the operation of the tool.
Figure 10C:
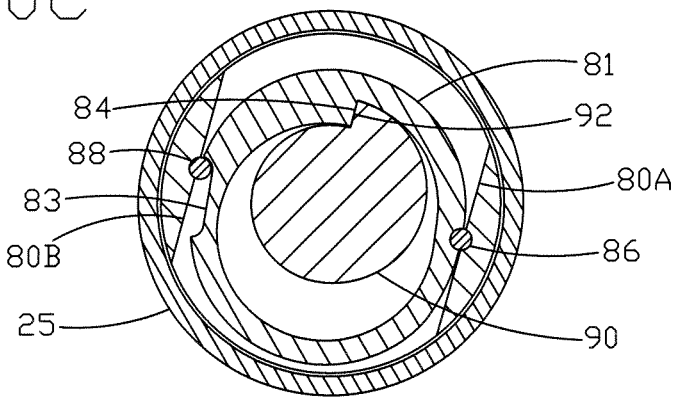

In FIG. 10B, percussion shaft 90 has been driven a few degrees clockwise by PDM 20. At the same time, eccentric ring 81 has been driven about eighty degrees clockwise due to the combined rotation of PDM 20 and mud turbine 55. Hammer 84 is positioned about ten degrees prior to impact with anvil 92. In FIG. 10C, the rapidly rotating hammer 84 impacts anvil 92, thereby transferring impulse momentum to percussion shaft 90.

Figure 10D:
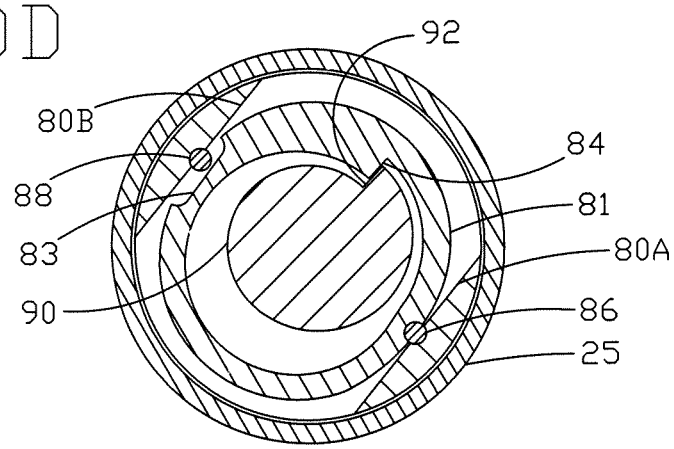
Figure 10E:
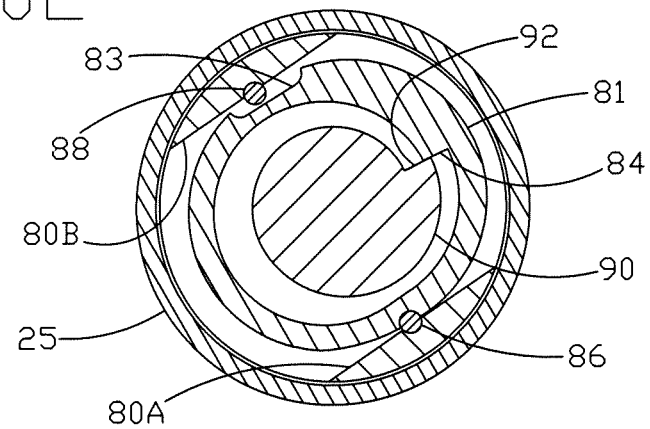
Figure 10F:
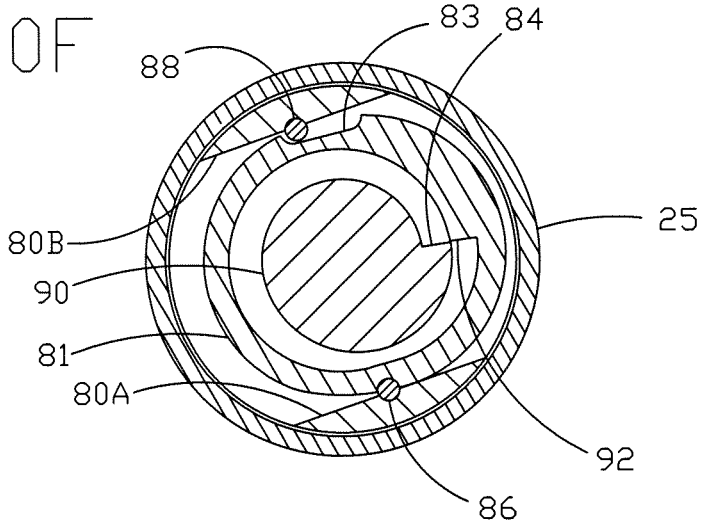

In FIG. 10D, percussion shaft 90 continues to rotate clockwise, driven by PDM 20. Anvil 92 checks the free rotation of eccentric ring 81, which in turn slows the rotation of turbine 55. As the high speed rotation of eccentric ring 81 is abruptly halted due to impact (FIG. 10C), the tangential component of the angular momentum of eccentric ring 81 urges eccentric ring to pivot clockwise about pivot pin 86. As shown in FIGS. 10D-10F, as percussion shaft 90 and eccentric ring 81 rotate together, eccentric ring 81 continues its tendency to pivot about pivot pin 86. Groove 83 and stopper pin 88 allow pivoting to proceed unchecked. In FIG. 10F, stopper pin 88 is positioned at near the extreme lagging position in groove 83, and hammer 84 is on the brink of breaking free from anvil 92.

Figure 10G:
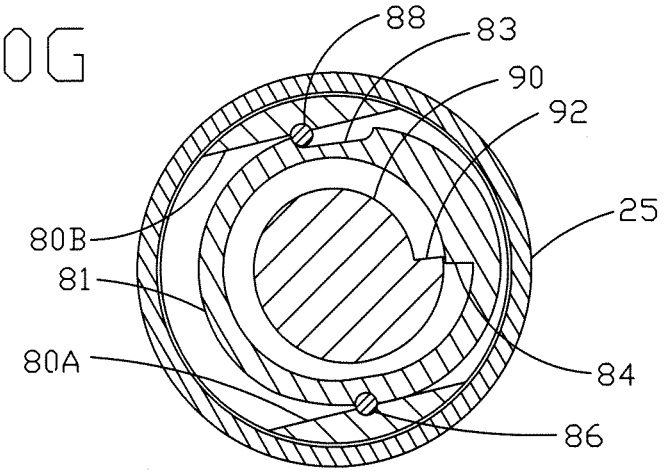
Figure 10H:
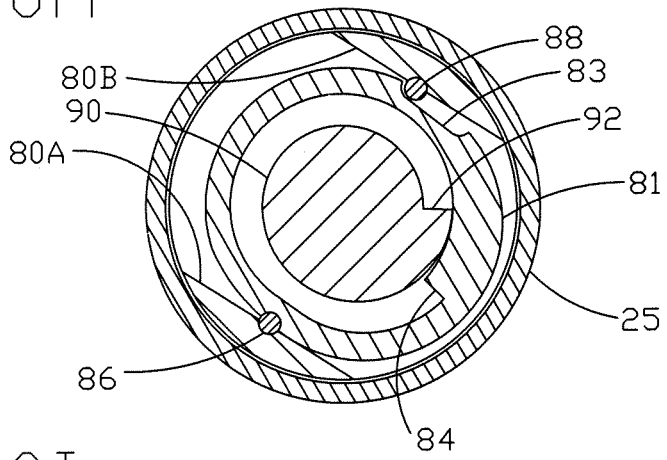
Figure 10I:
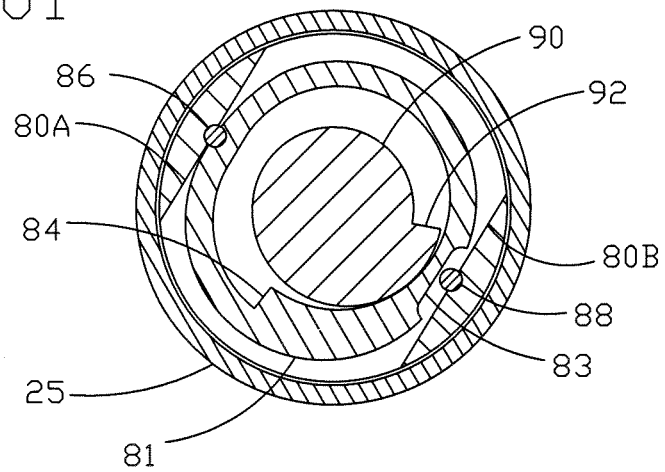
Figure 10J:
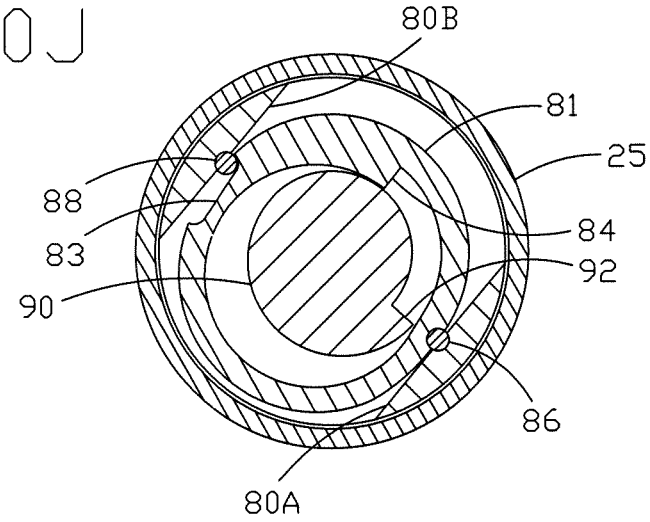

In FIG. 10G, eccentric ring is positioned in the disengaged position, with pin 88 being seated at the extreme lagging position in groove 83. Hammer 84 clears anvil 92. In FIGS. 10H and 10J, as yoke arms 80A, 80B accelerate past anvil 92 under the driving force of mud turbine 55, eccentric ring 81, which has an inertial tendency to lag yoke arms 80A, 80B, is caused to pivot back into an engaged position. In FIG. 10J, percussion assembly 72 is once again in the position of FIG. 10A—ninety degrees prior to impact. The cycle continues as percussion shaft 90 and yoke arms 80A, 80B rotate clockwise at differing rates.

The impulse energy transferred to percussion shaft 90 is most effective if it is directed substantially entirely into the formation being drilled. It is undesirable that impulse energy be directed into and absorbed by the mass of the entire drill string. Accordingly, percussion shaft 90 is partially decoupled rotationally from the housing 12 by a splined coupling assembly for permitting limited rotational freedom.

Figure 8:
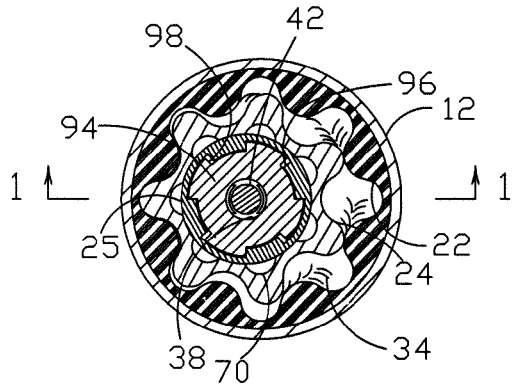
FIG. 8 is a transverse cross-section taken along lines 8-8 of FIG. 1, showing a splined coupling assembly by which rotation of the lobed rotor is transferred to the percussion drive shaft.
Figure 11:
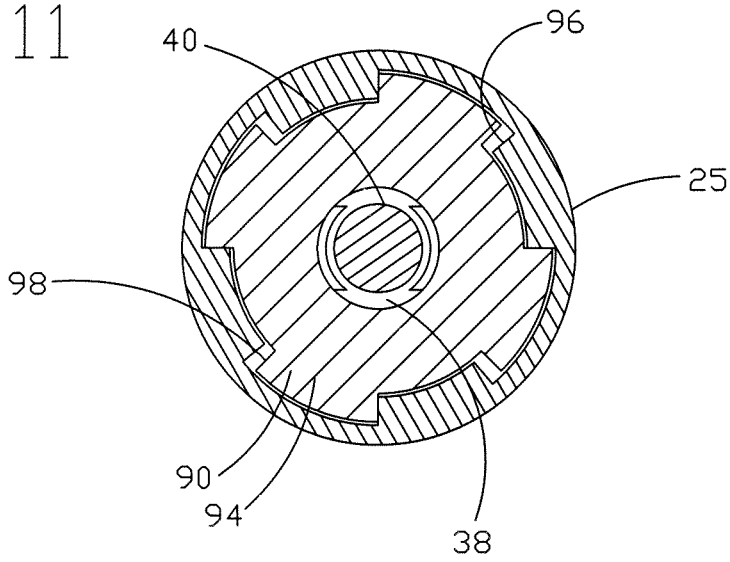
FIG. 11 is an enlarged partial view of FIG. 8, showing the splined coupling assembly of the percussion generating assembly.

Referring now to FIGS. 1, 8, and 11, splined coupling assembly includes an enlarged boss 94 formed at the lower end of percussion shaft 90. The lower end of boss 94 includes a recess that houses upper universal joint 38, which connects boss 94 to drive shaft 42 so that rotation of percussion shaft 90 rotates drive shaft 42. Boss 92 has axial grooves formed about its circumference, thus defining radially projecting ears 98. The interior surface of sleeve 25 includes an equal number of projecting teeth 96 extending radially inwards that are received into the grooves defined between ears 98. In an preferred embodiment, four grooves, each spanning a forty-five degree arc, are circumferentially intervaled about boss 94, thereby defining four radially projecting ears 98 of forty-five degrees each. Four corresponding inwardly projecting teeth 96, each spanning a forty degree arc, are circumferentially intervaled about the interior surface of sleeve 25, separated by fifty degrees between each. Accordingly, the percussion shaft is able to rotate only five degrees independently of rotor 24.

During operation, the rotating rotor 24 advances the forty-degree-wide teeth 96 within the forty-five-degree-wide grooves to engage ears 98 to rotate boss 94, which in turn drives box fitting 44 via drive shaft 42 and universal joints 38, 40. Each impact of hammer 84 against anvil 92 causes percussion shaft to be momentarily rotated a few degrees ahead of the driving rotation of rotor 24. On impact, ears 98 disengage from teeth 96, thereby momentarily decoupling boss 94, drive shaft 42, box fitting 44, and the attached drill bit (not illustrated) from PDM 20, housing 12, and the attached drill string. In this manner, substantially all of the impact energy is imparted it into the drill bit without the need of accelerating the entire drill string.

Figure 12:
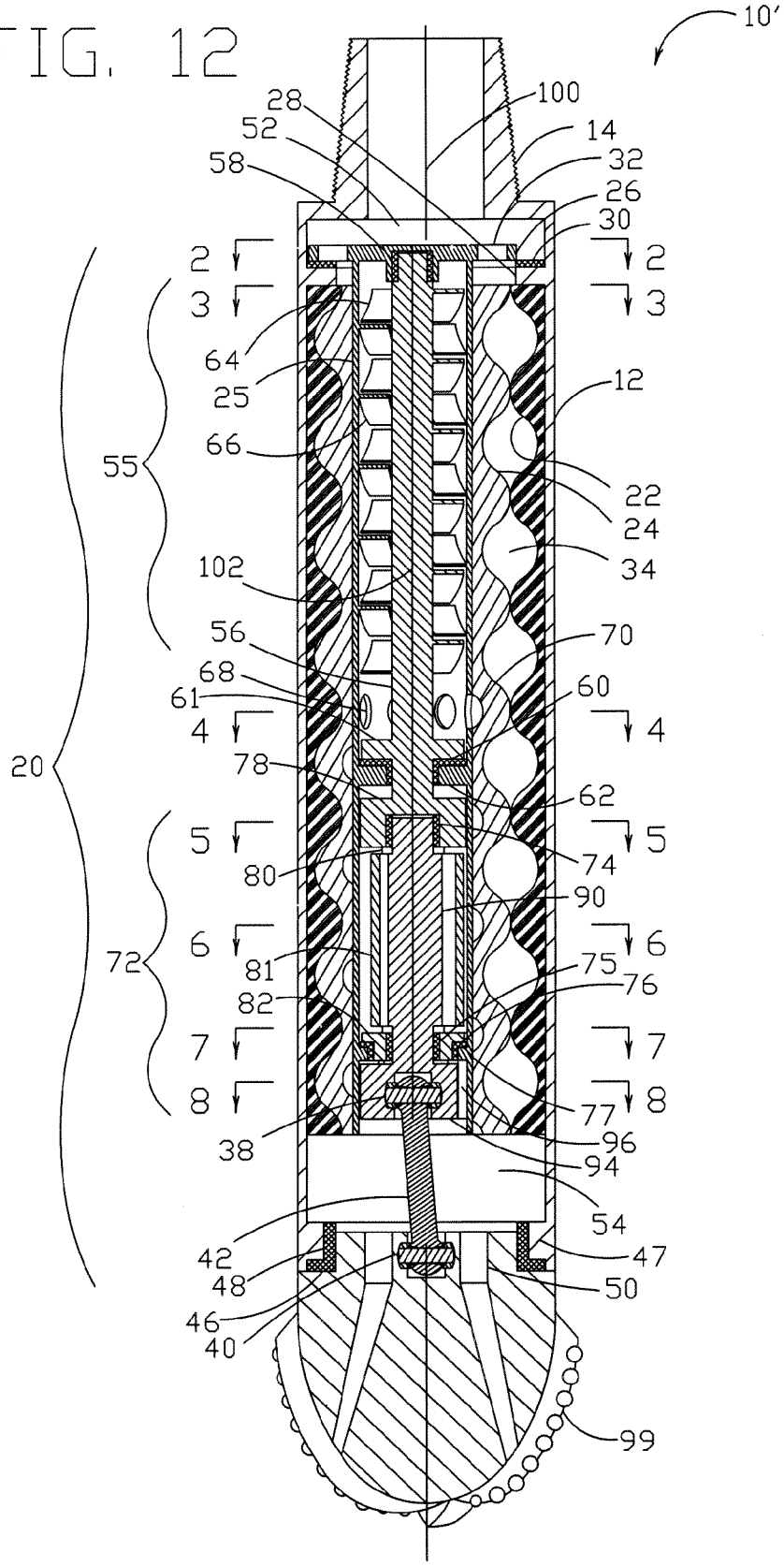
FIG. 12 is a side view in axial cross-section of a percussive impact tool, a positive displacement downhole mud motor, and a drag-type drill bit all integrated into a single short bit-to-bend tool according to a second embodiment of the invention.

FIG. 12 illustrates a downhole tool 10' according to a second embodiment of the invention. Tool 10' of FIG. 12 is substantially identical to tool 10 of FIG. 1, except that box fitting 44, into which a drill bit is threaded, is replaced by a drill bit 99. Bit 99 attaches directly to lower universal joint 40 without a pin and box connection, thereby providing a shorted bit-to-bend length.

FIG. 13 illustrates a downhole tool 10" according to an alternate embodiment of the invention. Tool 10" includes a bottom hole assembly, which includes a conventional PDM power section assembly 220, a conventional transmission or coupling assembly 242, and a novel bearing assembly 274. Tool 10" may optionally include a dump valve or cross-over sub 300, a safety catch sub 302, and a stabilizer 304, as is known to those of ordinary skill in the art.

Bearing assembly 274 may include upper and lower radial bearings 275, 276, and thrust bearings 278. Thrust bearings 278 may be of the conventional multiple ball and race design or other suitable arrangements as is known in the art. A turbine 255 and percussion assembly 272, of substantially similar design as turbine 55 and percussion assembly 72 of FIG. 1, is disposed within a central bore within bearings assembly 274.

As drilling fluid flow through tool 10", rotor 224 orbits within stator 222, thereby turning driveshaft 241 via universal joints 238, 240, which in turn rotates a sleeve 212 within bearing assembly 274. The rotation of sleeve 212 is transferred to a working end 299 via a splined coupling assembly as described above with respect to the embodiment of FIG. 1. Concurrently, drilling fluid flows through turbine 255, which periodically accelerates percussion assembly 274 to provide torque impulses to working end 299 as described above with respect to the embodiment of FIG. 1. The working end may be a box fitting (as shown in FIG. 13) or may be integrally formed with drill bit (such as working end 99 illustrated in FIG. 12), for example. Using a working end 299 that is integrally formed with a drill bit reduces bit to bend for superior control while directional drilling.

The embodiments described above all utilize a turbine to drive the hammer 84 into the anvil 92 for imparting a periodic rotational impact to the bit. However, other arrangements may be used as appropriate. For example, current Tork-Buster® units provided by Ulterra Drilling Technologies, LP include one or more valves that are sequentially actuated so as to port hydraulic fluid to forcefully drive the hammer into the anvil, in much the same way that a jack hammer operates. Accordingly, the scope of the present invention includes embodiments in which any means of imparting a periodic rotational impact to the bit is disposed within the rotor or bearing section of a progressive cavity mud motor.

The Abstract of the disclosure is written solely for providing the United States Patent and Trademark Office and the public at large with a way by which to determine quickly from a cursory reading the nature and gist of the technical disclosure, and it represents solely a preferred embodiment and is not indicative of the nature of the invention as a whole.

While some embodiments of the invention have been illustrated in detail, the invention is not limited to the embodiments shown; modifications and adaptations of the above embodiment may occur to those skilled in the art. Such modifications and adaptations are in the spirit and scope of the invention as set forth herein:

What is claimed is:

1. An apparatus for boring a hole in the earth comprising:
a cylindrical housing (12);
a progressive cavity motor (20) disposed within said housing and having a rotor (24) rotatively captured within a stator (22), said progressive cavity motor defining a progressive cavity fluid flow path between said stator and said rotor;
a bearing assembly disposed in said housing below said progressive cavity motor;
an operating member (16, 99) rotatively coupled to a lower end of said housing by said bearing assembly and connected to said rotor via a transmission assembly; and
a percussion assembly (72) disposed in one of the group consisting of said rotor and said bearing assembly, said percussion assembly coupled to said operating member for periodically imparting torque impulses to said operating member.

2. The apparatus of claim 1 further comprising:
a turbine (55) coupled to said percussion assembly for driving said percussion assembly.

3. The apparatus of claim 2 wherein:
said turbine (55) is disposed in one from the group consisting of said rotor and said bearing assembly.

4. The apparatus of claim 3 wherein:
said turbine and said percussion assembly are disposed in a bore formed through said rotor;
a first portion of a fluid flow entering an upper end of said tubular housing flows through said progressive cavity fluid flow path thereby rotating said rotor, and
a second portion of said fluid flow entering said upper end of said tubular housing flows through and rotates said turbine.

5. The apparatus of claim 3 wherein:
said turbine and said percussion assembly are disposed in said bearing assembly; and
all of a fluid flow through said progressive cavity fluid flow path also flows through and rotates said turbine.

6. The apparatus of claim 1 wherein:
said operating member includes a box fitting (16).

7. The apparatus of claim 1 wherein:
said operating member forms a drill bit (99).

8. A method for boring a hole in the earth comprising the steps of:
providing a bottom hole assembly including a cylindrical housing (12), a progressive cavity motor (20) disposed within said housing and having a rotor (24) rotatively captured within a stator (22), a bearing assembly disposed in said housing below said progressive cavity motor, a drill bit (99) rotatively coupled to a lower end of said housing by said bearing assembly and connected to said rotor via a transmission assembly, and a percussion assembly disposed (72) in one of the group consisting of said rotor and said bearing assembly;
pumping a first flow of drilling fluid through said progressive cavity motor thereby causing said drill bit to rotate; and
periodically imparting torque impulses to said drill bit using said percussion assembly while said is rotating.

9. The method of claim 8 wherein:
said bottom hole assembly includes a turbine (55) coupled to said percussion assembly for driving said percussion assembly; and
the method further comprises the step of pumping a second flow drilling fluid through said turbine so as to cause said step of periodically imparting torque impulses.

10. The method of claim 9 wherein:
said turbine (55) is disposed in one from the group consisting of said rotor and said bearing assembly.

11. The method of claim 10 wherein:
said turbine and said percussion assembly are disposed in a bore formed through said rotor.

12. The method of claim 10 wherein:
said turbine and said percussion assembly are disposed in said bearing assembly.

* * * * *